US009115475B2

(12) United States Patent
Runggaldier

(10) Patent No.: US 9,115,475 B2
(45) Date of Patent: Aug. 25, 2015

(54) SKI SLOPE SNOW GROOMING METHOD AND RELATIVE IMPLEMENT

(75) Inventor: Martin Runggaldier, St. Christina (IT)

(73) Assignee: SNOWGROLIC S.AR.L., Luxembourg (LU)

( * ) Notice: Subject to any disclaimer, the term of this patent is extended or adjusted under 35 U.S.C. 154(b) by 186 days.

(21) Appl. No.: 13/812,109

(22) PCT Filed: Jul. 28, 2011

(86) PCT No.: PCT/IB2011/001749

§ 371 (c)(1),
(2), (4) Date: Mar. 28, 2013

(87) PCT Pub. No.: WO2012/014053

PCT Pub. Date: Feb. 2, 2012

(65) Prior Publication Data

US 2013/0192096 A1 Aug. 1, 2013

(30) Foreign Application Priority Data

Jul. 28, 2010 (IT) ..... MI2010A001409

(51) Int. Cl.
*E01H 4/02* (2006.01)

(52) U.S. Cl.
CPC ..... *E01H 4/02* (2013.01)

(58) Field of Classification Search
CPC ..... E01H 5/106; B23K 26/0081
USPC ..... 37/196, 197, 219, 220, 221, 226, 227; 219/121.65, 121.66
See application file for complete search history.

(56) References Cited

U.S. PATENT DOCUMENTS

| | | | | | |
|---|---|---|---|---|---|
| 3,559,337 | A | * | 2/1971 | Marcoux et al. | 47/1.3 |
| 3,763,348 | A | * | 10/1973 | Costello | 392/423 |
| 3,964,183 | A | * | 6/1976 | Mouat | 37/197 |
| 4,110,919 | A | * | 9/1978 | Henrichon | 37/219 |
| 4,379,217 | A | * | 4/1983 | Youmans | 219/121.6 |
| 4,636,607 | A | * | 1/1987 | Hayd et al. | 219/121.85 |
| 4,900,891 | A | * | 2/1990 | Vega et al. | 219/121.6 |
| 5,075,987 | A | | 12/1991 | Akiyama et al. | |
| 5,140,762 | A | * | 8/1992 | Monson | 372/30 |
| 5,680,715 | A | * | 10/1997 | Thiboutot et al. | 37/219 |
| 5,823,474 | A | * | 10/1998 | Nunnally | 244/134 E |
| 6,226,454 | B1 | * | 5/2001 | Couture | 392/419 |
| 7,578,634 | B2 | * | 8/2009 | Velsor | 404/95 |

FOREIGN PATENT DOCUMENTS

| | | |
|---|---|---|
| DE | 296 00 905 | 5/1996 |
| DE | 10 2004 011462 | 9/2005 |
| EP | 1 995 159 | 11/2008 |

OTHER PUBLICATIONS

PCT Request (Form PCT/RO/101) for International Application No. PCT/IB2011/001749 dated Jul. 28, 2011.
Notification Concerning Submission, Obtention or Transmittal of Priority Document (Form PCT/IB/304) for International Application No. PCT/IB2011/001749 dated Oct. 26, 2011.
International Search Report and Written Opinion for International Application No. PCT/IB2011/001749 dated May 7, 2012.

* cited by examiner

*Primary Examiner* — Gary Hartmann
(74) *Attorney, Agent, or Firm* — Neal, Gerber & Eisenberg LLP

(57) ABSTRACT

A ski slope snow grooming method, whereby a ski slope grooming implement is moved in a travelling direction along the snow covering; and coherent-energy beams are projected onto the snow covering to form furrows in the snow covering.

5 Claims, 4 Drawing Sheets

SKI SLOPE SNOW GROOMING METHOD AND RELATIVE IMPLEMENT

PRIORITY CLAIM

This application is a national stage application of PCT/IB2011/001749, filed on Jul. 28, 2011, which claims the benefit of and priority to Italian Patent Application No. MI2010A 001409, filed on Jul. 28, 2010, the entire contents of which are each incorporated by reference herein.

BACKGROUND

Certain known methods of grooming the snow covering of ski slopes is to flatten any mounds of snow using a blade fitted to the front of a crawler groomer; compact the snow covering using the groomer tracks; till a surface layer of the snow covering using a rotary tiller fitted to the rear of the groomer; and smooth the tilled snow covering using a mat mounted downstream from the rotary tiller, and which forms longitudinal furrows parallel to the travelling direction of the groomer.

The above steps can often be performed in different sequences, depending on the type of snow, temperature, ski slope gradient, etc., to achieve a snow covering of a given or designated particle size and density. One example of a groomer of the above type is described in European Patent No. 1,995,159.

The most energy-intensive grooming step is tilling the snow covering, especially when this is hard and icy.

As described in PCT Patent Application No. WO 2009/034184, PCT Patent Application No. WO 2009/034185, PCT Patent Application No. WO 2009/056576 and PCT Patent Application No. WO 2009/056578, the rotary tiller comprises a shaft rotated by a hydraulic or electric motor; and a number of teeth projecting from the shaft. The tiller is confined between the snow covering and a hood and, in use, the teeth on the tiller penetrate the snow covering and hurl clumps of snow against the hood to break up the clumps and form a hard surface layer on the snow covering of a given or designated particle size.

This known grooming method gives good results in terms of quality, but is highly energy-intensive.

SUMMARY

The present disclosure relates to a ski slope snow grooming method.

It is an advantage of the present disclosure to provide a snow grooming method configured to eliminate certain of the above-described drawbacks typically associated with such known methods.

More specifically, it is an advantage of the present disclosure to provide a snow grooming method which provides for high-quality, relatively low-power grooming.

According to one embodiment of the present disclosure, there is provided a method of grooming the snow covering of ski slopes, the method comprising the steps of moving a ski slope grooming implement in a travelling direction along the snow covering; and projecting coherent-energy beams from the implement onto the snow covering to form furrows in the snow covering.

In other words, as opposed to using mechanical power to detach and lift clumps off the snow covering, coherent-energy, furrow-forming beams locally and instantly melt a portion of the snow covering, thus greatly reducing the power required to groom the snow covering.

In certain embodiments of the present disclosure, the coherent-energy beams are defined by electromagnetic waves in the visible range. In one such embodiment, the coherent-energy beams are defined by laser beams.

In certain embodiments of the present disclosure, the method comprises selecting the power of each coherent-energy beam as a function of the travelling speed of the coherent-energy beam.

In certain embodiments of the present disclosure, the method comprises selecting the power of each coherent-energy beam as a function of the depth of the respective furrow.

In another embodiment of the present disclosure, the method comprises selecting the tilt of the coherent-energy beam with respect to the surface of the snow covering.

Another advantage of the present disclosure is to provide an implement configured or designed to eliminate certain of the above-described drawbacks of such known ski slope snow grooming implements.

According to the present disclosure, there is provided an implement configured to groom the snow covering of ski slopes, the implement being configured or designed to be moved in a travelling direction along the snow covering, and comprising a number or quantity of emitters configured to emit and project coherent-energy beams onto the snow covering to form furrows in the snow covering.

Additional features and advantages are described in, and will be apparent from the following Detailed Description and the figures.

BRIEF DESCRIPTION OF THE DRAWINGS

A number of non-limiting embodiments of the present disclosure will be described by way of example with reference to the attached drawings, in which.

DETAILED DESCRIPTION

Figure 1:
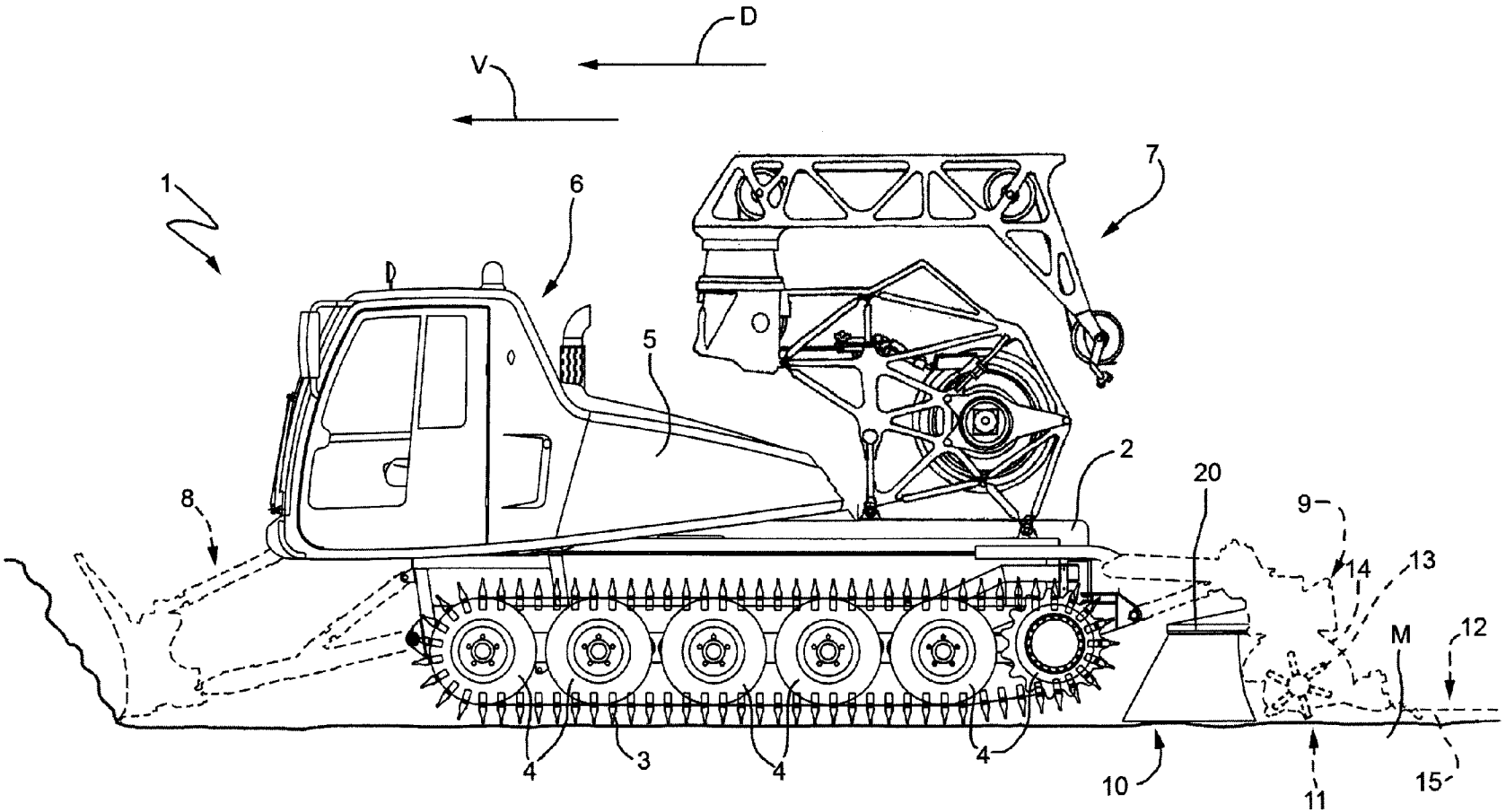
FIG. 1 shows a side view, with parts removed for clarity, of a groomer configured to implement the ski slope snow grooming method according to the present disclosure.

Referring now to the example embodiments of the present disclosure illustrated in FIGS. 1 to 8, number 1 in FIG. 1 indicates as a whole a ski slope groomer. Groomer 1 comprises a frame 2; tracks 3 looped about wheels 4; an engine compartment 5; and a cab 6. The groomer 1 in FIG. 1 also comprises a winch 7 configured to assist the groomer up particularly steep slopes. Groomer 1 is configured or designed to groom a snow covering M, along which it is driven in a direction D at a variable travelling speed V, and accordingly comprises a blade 8 fitted to the front of frame 2 to flatten any mounds of snow; and a grooming device 9 fitted to the rear of frame 2 to groom snow covering M to a smooth, ski-safe conformation.

In the FIG. 1 example, grooming device 9 comprises a succession of three implements 10, 11, 12.

Implements 11 and 12 are conventional types defined by a tiller 13 housed in a hood 14, and by a flexible mat 15 respectively.

Depending on the condition of snow covering M, implement 10 is configured or designed to groom snow covering M either in conjunction with implements 11 and 12, or independently, in which case, it is capable of grooming snow covering M completely, with no help from implements 11 and 12.

Figure 2:
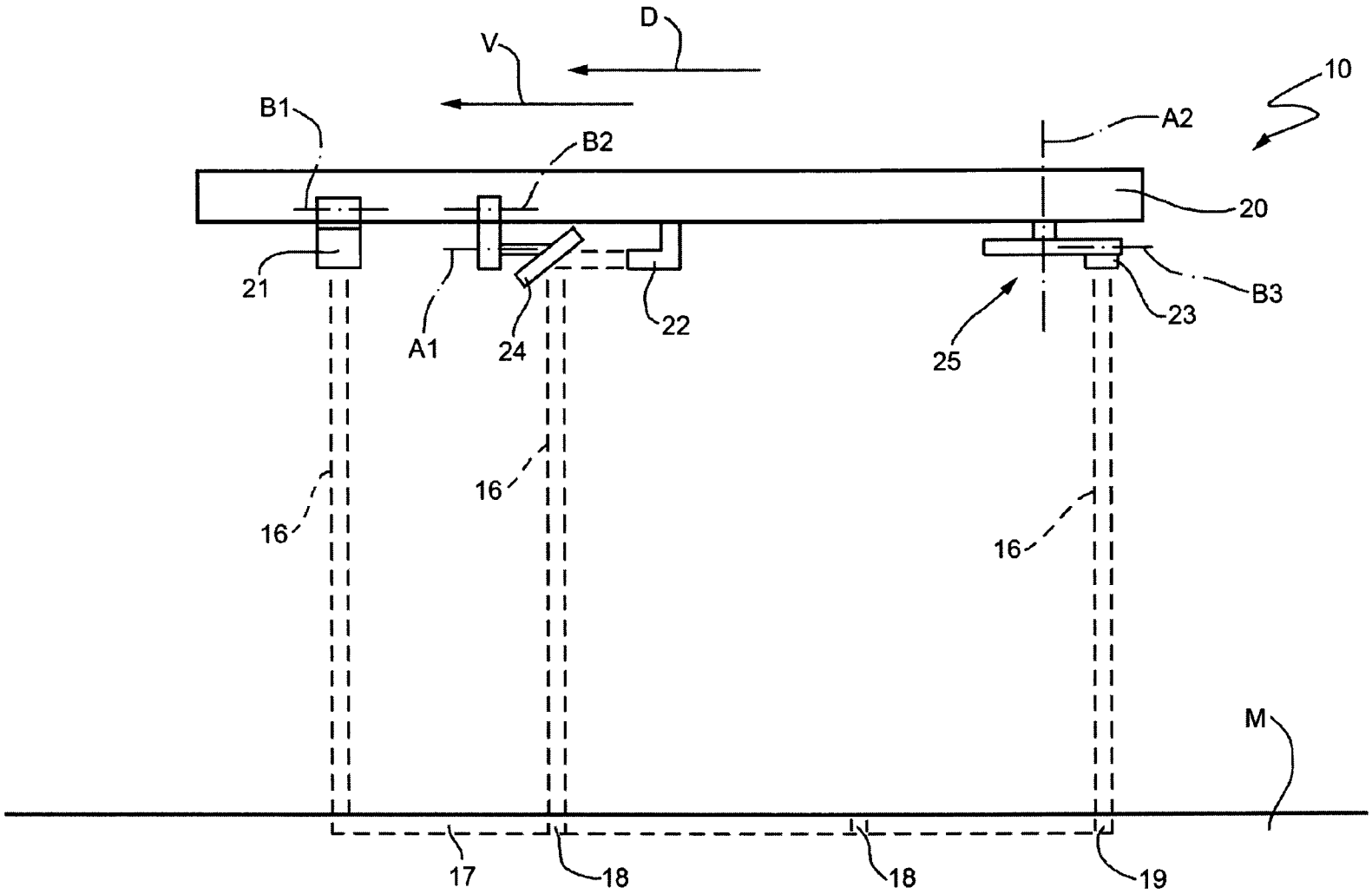
FIG. 2 shows a schematic, with parts removed for clarity, of an implement configured to implement the grooming method according to the present disclosure.

With reference to FIG. 2, implement 10 is configured or designed to project coherent-energy beams 16 onto snow covering M, to form furrows 17, 18, 19 in snow covering M as it travels in direction D at speed V.

Each coherent-energy beam 16 interacts with snow covering M to melt a portion of snow covering M; furrows 17, 18, 19 are formed by the movement of coherent-energy beams 16 along snow covering M; and the movement of each coherent-energy beam 16 is produced by the movement of groomer 1 in travelling direction D (as seen in FIG. 1) and by any additional movements of coherent-energy beam 16.

In one embodiment, coherent-energy beam 16 is defined by a laser beam, but alternative embodiments of the present disclosure employ electromagnetic waves, microwaves, sound waves, water jets, and air jets in general.

The depth of furrows 17, 18, 19 depends on the energy discharged onto snow covering M, and on the characteristics of snow covering M, such as density, particle size and temperature; the instantaneous energy discharged onto snow covering M depends on the power of coherent-energy beam 16 and the travelling speed of coherent-energy beam 16 with respect to snow covering M; and the travelling speed of coherent-energy beam 16 depends on the travelling speed V of groomer 1, and the speed of any additional movement of coherent-energy beam 16.

The power of coherent-energy beam 16 is adjustable according to the characteristics of snow covering M, the target depth of furrow 17, 18 or 19, travelling speed V, and the speed of any additional movement of coherent-energy beam 16, and can be adjusted both manually and automatically as a function of travelling speed V. In automatic adjustment mode, all other characteristics being equal, the power of coherent-energy beam 16 increases linearly with travelling speed V.

Figure 3:
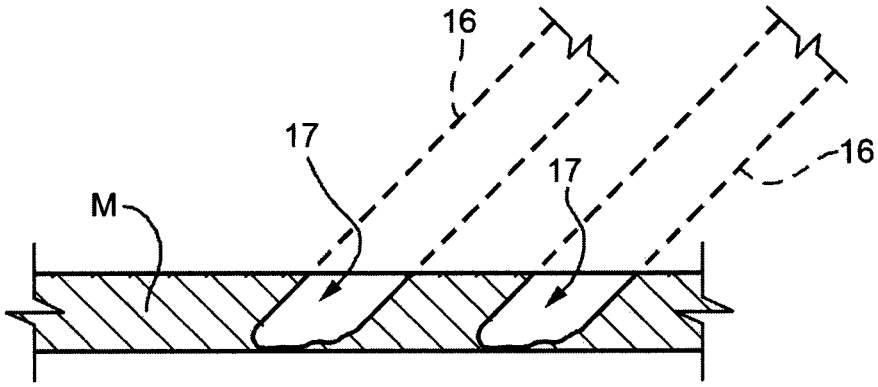
FIGS. 3 and 4 show sections of the snow covering groomed using the method according to the present disclosure.
Figure 4:
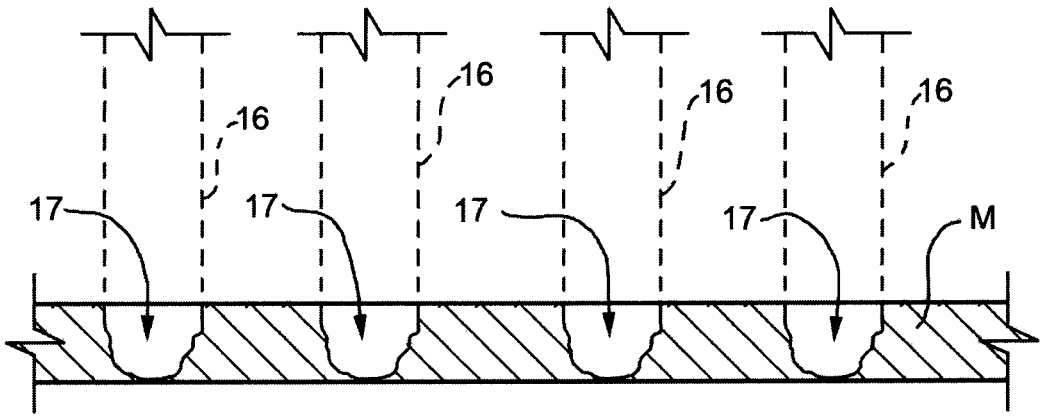

As shown in FIGS. 3 and 4, coherent-energy beam 16 is adjustable to different angles of incidence with snow covering M. FIG. 3 shows coherent-energy beams 16 tilted (i.e., other than perpendicular), with respect to the surface of snow covering M; and FIG. 4 shows coherent-energy beams 16 perpendicular to the surface of snow covering M. The FIG. 3 furrows 17 formed by tilted coherent-energy beams 16 have lateral walls sloping with respect to the surface of snow covering M, and the portions of snow covering M between adjacent furrows 17 are substantially fragile. Conversely, the FIG. 4 furrows 17 formed by coherent-energy beams 16 perpendicular to the surface of snow covering M form more stable snow covering M portions. In other words, different tilt settings of coherent-energy beams 16 produce different snow covering M structures.

Implement 10 in FIG. 2 comprises a frame 20 drawn by groomer 1 (as seen in FIG. 1) in direction D at speed V, and which supports a row of first emitters 21, a row of second emitters 22, and a row of third emitters 23, all configured to emit coherent-energy beams 16.

Figure 5:
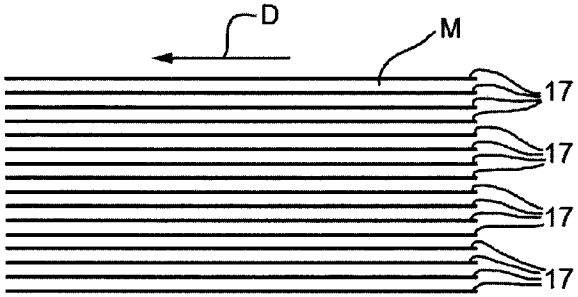

The row of first emitters 21 extends perpendicular to the FIG. 2 plane, and comprises a number or quantity of first emitters 21, such as a quantity of equally spaced first emitters, each facing snow covering M and fitted to frame 20 adjustably about an axis B1 to adjust the incidence angle of respective coherent-energy beam 16 with respect to snow covering M. In one embodiment, emitters 21 are adjusted remotely by a servomechanism (not shown), such as from cab 6 of groomer 1 (as seen in FIG. 1); and the row of first emitters 21 forms in snow covering M a number or quantity of furrows 17 parallel to one another and to travelling direction D, as shown in FIG. 5.

Figure 6:
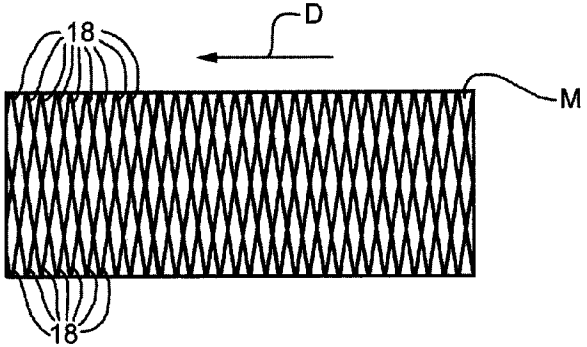
FIGS. 5, 6, 7 and 8 show schematic plan views of respective portions of snow covering groomed using the method according to the present disclosure.

As shown in FIG. 2, each second emitter 22, like the respective coherent-energy beam 16, is oriented parallel to travelling direction D, and is associated with a mirror 24 configured to divert the coherent-energy beam 16 onto snow covering M. Mirror 24 is fitted to frame 20 by a bracket adjustable about an axis B2 to adjust the angle of coherent-energy beam 16 with respect to snow covering M, and is fitted to the bracket to oscillate about an axis A1 and sweep a relatively wide strip of snow covering M. The oscillating movement of mirror 24 is controlled by an actuator (not shown); and a number or quantity of rows of second emitters 22, associated with respective mirrors, may be provided to form a pattern of furrows 18 in snow covering M as shown in FIG. 6.

Figure 7:
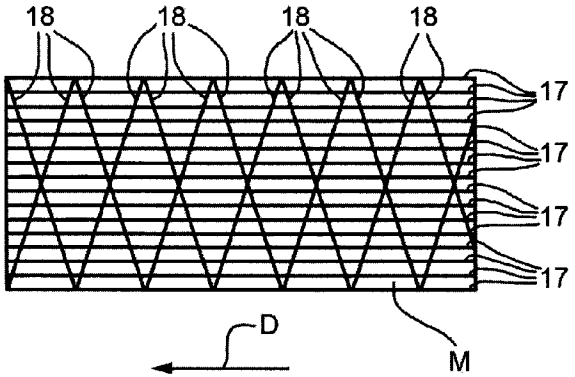

Combined, emitters 21 and emitters 22, associated with respective mirrors 24, form a pattern of intersecting furrows 17 and 18 as shown in FIG. 7.

As shown in FIG. 2, each emitter 23 is positioned facing snow covering M, is fitted to an actuating device 25 to rotate about an axis A2 with respect to frame 20, and is adjustable about an axis B3 to adjust its own tilt and that of respect coherent-energy beam 16 with respect to the surface of snow covering M.

Figure 8:
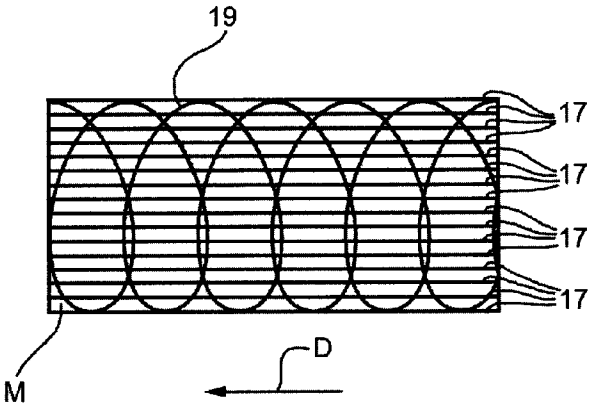

Generally speaking, each emitter 23 forms a furrow 19 which, in plan view, is substantially as shown in FIG. 8, which shows furrow 19 combined with furrows 17 made by emitters 21.

The method according to the present disclosure therefore provides for forming different patterns in the snow covering, either to groom the snow covering, or simply weaken a surface portion of the snow covering, so that follow-up grooming stages, particularly the tilling stage, call for less power, thus reducing the power consumption of the grooming process as a whole as compared with conventional methods.

Clearly, changes may be made to the method and implement as described herein without, however, departing from the scope of the accompanying Claims. It should thus be understood that various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A method of grooming a snow covering of a ski slope, the method comprising:

moving a ski slope grooming implement in a travelling direction along the snow covering; and projecting at least one coherent-energy beam from the ski slope grooming implement onto the snow covering to form, crosswise to the travelling direction, at least one furrow in the snow covering.

2. A method of grooming a snow covering of a ski slope, the method comprising:

moving a ski slope grooming implement in a travelling direction along the snow covering; and projecting a plurality of coherent-energy beams from the ski slope grooming implement onto the snow covering to form a plurality of furrows in the snow covering, wherein at least two of the plurality of furrows are formed parallel to the travelling direction and at least two of the plurality of furrows are formed crosswise to the travelling direction.

3. The method of claim 2, which includes forming at least two of the furrows extending along a plurality of curved paths.

4. A ski slope snow grooming implement configured to be moved in a travelling direction along a snow covering, said ski slope snow grooming implement comprising:

a frame; and at least one emitter configured to emit and project at least one coherent-energy beam onto the snow covering to form at least one furrow in the snow covering, said at least one emitter including at least one emitter associated with a mirror configured to oscillate with respect to the frame to selectively divert the coherent-energy beam and form at least one furrow crosswise to the travelling direction.

5. A ski slope snow groomer configured to be moved in a travelling direction along a snow covering, said ski slope snow groomer comprising:

a frame;

a plurality of wheel assemblies on opposite sides of the frame;

a plurality of tracks wound respectively about the plurality of wheel assemblies; and a ski slope snow grooming device fitted to the frame, said ski slope snow grooming device including at least one emitter rotary fitted to the frame and configured to emit and project at least one coherent-energy beam onto the snow covering to form at least one furrow in the snow covering, said at least one furrow extending along at least one curved path.

* * * * *